US009551336B2

(12) United States Patent
Nakaima et al.

(10) Patent No.: US 9,551,336 B2
(45) Date of Patent: Jan. 24, 2017

(54) VARIABLE DISPLACEMENT SWASH PLATE TYPE COMPRESSOR

(71) Applicant: KABUSHIKI KAISHA TOYOTA JIDOSHOKKI, Kariya-shi, Aichi-ken (JP)

(72) Inventors: Hiroyuki Nakaima, Kariya (JP); Shinya Yamamoto, Kariya (JP); Kengo Sakakibara, Kariya (JP); Yusuke Yamazaki, Kariya (JP); Takahiro Suzuki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 245 days.

(21) Appl. No.: 14/564,305

(22) Filed: Dec. 9, 2014

(65) Prior Publication Data

US 2015/0159645 A1 Jun. 11, 2015

(30) Foreign Application Priority Data

Dec. 11, 2013 (JP) ..... 2013-256238

(51) Int. Cl.
*F04B 27/18* (2006.01)
*F04B 49/08* (2006.01)
(Continued)

(52) U.S. Cl.
CPC ..... *F04B 49/08* (2013.01); *F04B 1/146* (2013.01); *F04B 1/295* (2013.01); *F04B 27/086* (2013.01);
(Continued)

(58) Field of Classification Search
CPC . F04B 27/18; F04B 27/1804; F04B 2027/184; F04B 2027/185; F04B 2027/1845; F04B 2027/1859; F04B 2027/1863
(Continued)

(56) References Cited

U.S. PATENT DOCUMENTS 4,061,443 A 12/1977 Black et al.
6,533,555 B2 * 3/2003 Yamada ..... F04B 27/1036 417/222.2
(Continued)

FOREIGN PATENT DOCUMENTS

JP 8-105384 A 4/1996
KR 10-0869930 B1 11/2008

OTHER PUBLICATIONS

Communication dated May 11, 2016 from the State Intellectual Property Office of the P.R.C. in counterpart Chinese application No. 201410766493.X.

*Primary Examiner* — Patrick Hamo
(74) *Attorney, Agent, or Firm* — Sughrue Mion, PLLC

(57) ABSTRACT

In a compressor that changes a discharge capacity by using an actuator, a variable displacement swash plate type compressor capable of realizing reduction in manufacture cost is provided.

In the compressor of the present invention, a ring groove is formed in a movable body, and the ring groove is provided with an annular member. The annular member has a joint gap formed by a first to a third cutouts, and the third cutout is an aperture. In this compressor, the annular member moves in the ring groove based on a pressure difference between a control pressure chamber and a swash plate chamber. Thereby, in the compressor, a pressure in the control pressure chamber is regulated by regulating a flow of a refrigerant that flows to the swash plate chamber from the control pressure chamber.

5 Claims, 7 Drawing Sheets

(51) Int. Cl.

| | |
|---|---|
| ***F04B 1/14*** | (2006.01) |
| ***F04B 1/29*** | (2006.01) |
| ***F04B 27/08*** | (2006.01) |
| ***F04B 27/10*** | (2006.01) |

(52) U.S. Cl.
CPC ..... *F04B 27/1072* (2013.01); *F04B 27/1804* (2013.01); *F04B 2027/1831* (2013.01); *F04B 2027/1859* (2013.01)

(58) Field of Classification Search
USPC ..... 417/222.1, 222.2
See application file for complete search history.

(56) References Cited

U.S. PATENT DOCUMENTS

| | | | | |
|---|---|---|---|---|
| 6,558,133 | B2 * | 5/2003 | Fukanuma | F04B 27/109 417/222.2 |
| 6,663,355 | B2 * | 12/2003 | Kubo | F04B 27/1804 417/222.2 |
| 7,452,192 | B2 * | 11/2008 | Hirota | F04B 27/1804 251/129.15 |
| 7,530,797 | B2 * | 5/2009 | Ito | F04B 27/1063 417/222.1 |
| 7,699,585 | B2 * | 4/2010 | Fukanuma | F04B 27/1036 417/222.1 |
| 2003/0035732 | A1 * | 2/2003 | Yokomachi | F04B 27/109 417/222.2 |

* cited by examiner

VARIABLE DISPLACEMENT SWASH PLATE TYPE COMPRESSOR

TECHNICAL FIELD

The present invention relates to a variable displacement swash plate type compressor.

BACKGROUND ART

Japanese Patent Laid-Open No. 8-105384 discloses a conventional variable displacement swash plate type compressor (hereinafter, described as a compressor). In the compressor, a housing is formed by a front housing, a cylinder block and a rear housing. In the front housing and the rear housing, suction chambers and discharge chambers are respectively formed. Further, in the rear housing, a control pressure chamber is formed.

In the cylinder block, a swash plate chamber, a plurality of cylinder bores and a center bore are formed. The center bore is formed at a rear side of the cylinder block.

A drive shaft is inserted through the housing, and is rotatably supported in the housing. In the swash plate chamber, a swash plate that is rotatable by rotation of the drive shaft is provided. Between the drive shaft and the swash plate, a link mechanism that allows change of an inclination angle of the swash plate is provided. Here, the inclination angle refers to an angle which the swash plate forms with respect to a direction orthogonal to a rotational axis of the drive shaft.

Further, in the respective cylinder bores, pistons are respectively accommodated to be able to reciprocate, and compression chambers are respectively formed in the respective cylinder bores. A conversion mechanism causes the respective pistons to reciprocate in the cylinder bores at a stroke corresponding to the inclination angle, by rotation of the swash plate. Further, an actuator can change the inclination angle, and a control mechanism controls the actuator.

The actuator has a first movable body, a second movable body, a thrust bearing and the above described control pressure chamber. The first movable body is disposed in the center bore, and is movable in a rotational axis direction in the center bore. In the first movable body, a shaft hole through which a rear end portion of the drive shaft is inserted is formed. Thereby, the rear end portion of the drive shaft is rotatable in the shaft hole of the first movable body. The second movable body has the drive shaft inserted therethough. The second movable body is disposed forward of the first movable body, and is movable in the rotational axis direction. The thrust bearing is provided between the first movable body and the second movable body.

The control mechanism regulates the pressure of a refrigerant in the control pressure chamber by performing communication control of the control pressure chamber and the discharge chamber, besides performing communication control of the control pressure chamber and the suction chamber. Further, the control mechanism has an O-ring and a pair of searing rings. The O-ring and the respective sealing rings are located between an outer circumferential surface of the first movable body and an inner circumferential surface of the center bore. The respective sealing rings are disposed at a front end side and a rear end side of the first movable body with the O-ring therebetween. By the O-ring and the respective sealing rings, a space between the control pressure chamber and the swash plate chamber is sealed.

In this compressor, the control mechanism regulates the pressure of the refrigerant in the control pressure chamber, whereby the first and the second movable bodies and the thrust bearing can be moved in the rotational axis direction. Thereby, in this compressor, the link mechanism allows change of the inclination angle of the swash plate, and a discharge capacity per one rotation of the drive shaft is changeable.

In the above described conventional compressor, at a time of changing the discharge capacity, the control mechanism regulates the pressure of the refrigerant in the control pressure chamber by each communication control of the suction chamber and the discharge chamber, and the control pressure chamber while sealing the space between the control pressure chamber and the swash plate chamber. Therefore, in this compressor, work and means for preventing leakage of the refrigerant from the control pressure chamber are needed, and manufacture cost increases.

The present invention is made in the light of the above described conventional situation, and a problem to be solved by the invention is to provide a variable displacement swash plate type compressor capable of realizing reduction in manufacture cost in a compressor that changes a discharge capacity by using an actuator.

SUMMARY OF THE INVENTION

A variable displacement swash plate type compressor of the present invention comprises a housing in which a suction chamber, a discharge chamber, a swash plate chamber and a cylinder bore are formed, a drive shaft that is rotatably supported by the housing, a swash plate rotatable in the swash plate chamber by rotation of the drive shaft, a link mechanism that is provided between the drive shaft and the swash plate, and allows change of an inclination angle of the swash plate to a direction orthogonal to a rotational axis of the drive shaft, a piston that is accommodated in the cylinder bore to be capable of reciprocating, a conversion mechanism that causes the piston to reciprocate in the cylinder bore at a stroke corresponding to the inclination angle, by rotation of the swash plate, an actuator capable of changing the inclination angle, and a control mechanism that controls the actuator, wherein the swash plate chamber communicates with the suction chamber, the actuator has a stationary body fixed to the drive shaft in the swash plate chamber, a movable body movable in a direction of the rotational axis in the swash plate chamber, and a control pressure chamber defined by the stationary body and the movable body, the control mechanism has a supply passage that communicates with the discharge chamber and the control pressure chamber, and introduces a refrigerant in the discharge chamber to the control pressure chamber, and a bleed passage that communicates with the swash plate chamber and the control pressure chamber, and discharges the refrigerant in the control pressure chamber to the swash plate chamber, the bleed passage is provided at least one of a space between the movable body and the drive shaft, and a space between the movable body and the stationary body, the bleed passage is provided with an annular member having an aperture that always allows the control pressure chamber and the swash plate chamber to communicate with each other, and the annular member regulates a flow of the refrigerant that flows through the bleed passage by moving in the bleed passage based on a pressure difference between the control pressure chamber and the swash plate chamber.

Other aspects and advantages of the present invention will be apparent from embodiments disclosed in the attached drawings, illustrations exemplified therein, and the concept of the invention.

BRIEF DESCRIPTION OF THE DRAWINGS

FIG. 5A is a perspective view from above showing the annular member. FIG. 5B is an essential part enlarged front view showing the annular member. FIG. 5C is an enlarged sectional view seen in a direction of arrows C-C in FIG. 5B.

FIG. 7A shows a position of the annular member in the ring groove at a time of a state when a pressure difference of a control pressure chamber and a swash plate chamber is small. FIG. 7B shows a position of the annular member in the ring groove at a time of a state when the pressure difference of the control pressure chamber and the swash plate chamber is large.

FIG. 8A is a perspective view from above showing the annular member. FIG. 8B is an essential part enlarged front view showing the annular member. FIG. 8C is an enlarged sectional view seen in a direction of arrows C-C in FIG. 8B.

DETAILED DESCRIPTION OF EXEMPLARY EMBODIMENTS

Hereinafter, Embodiments 1 and 2 embodying the present invention will be described with reference to the drawings. Compressors in Embodiments 1 and 2 are variable displacement single head swash plate type compressors. These compressors are both mounted on vehicles, and configure refrigerant circuits of vehicle air-conditioning apparatuses.

Embodiment 1

Figure 1:
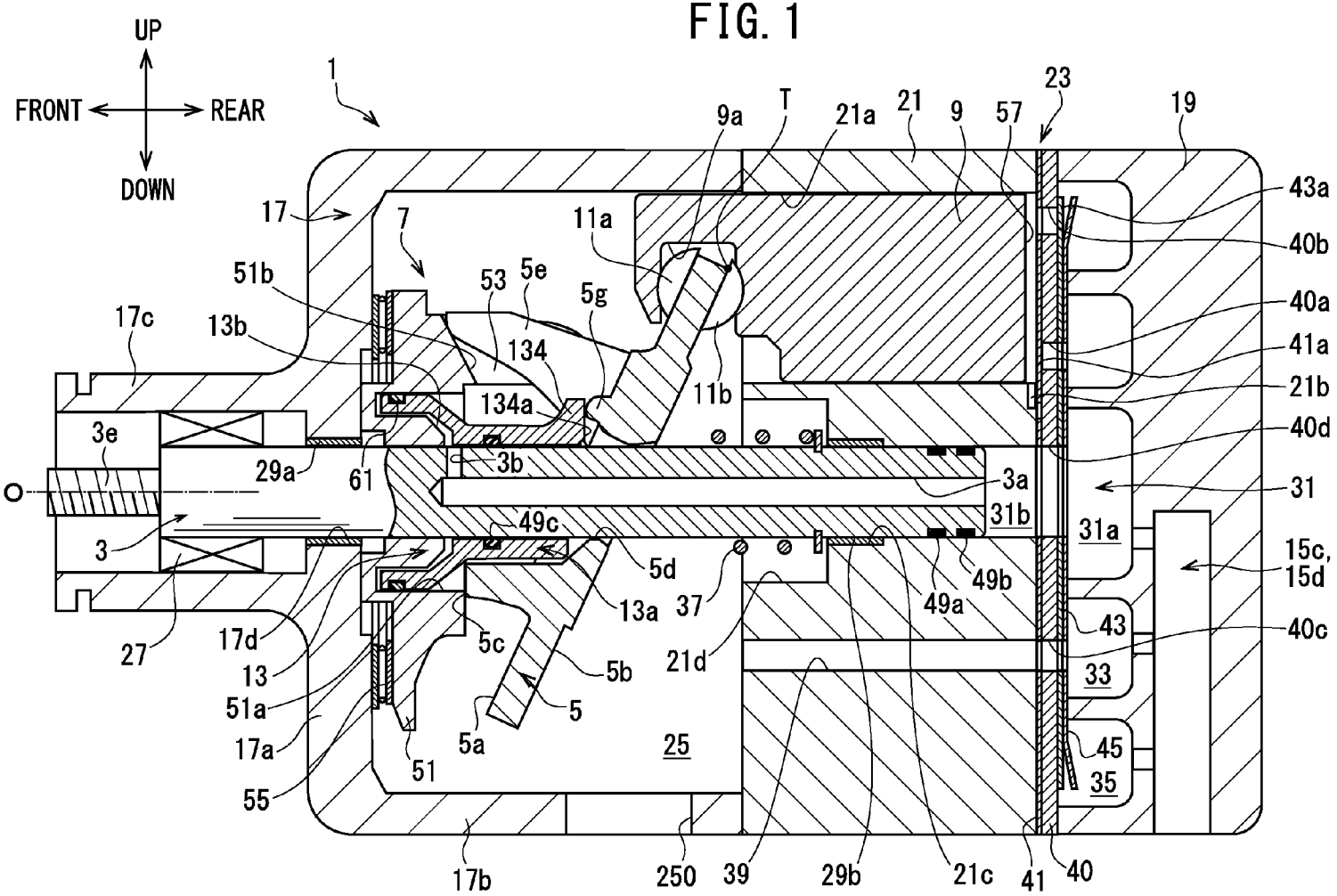
FIG. 1 is a sectional view at a time of a maximum capacity in a compressor of Embodiment 1.
Figure 2:
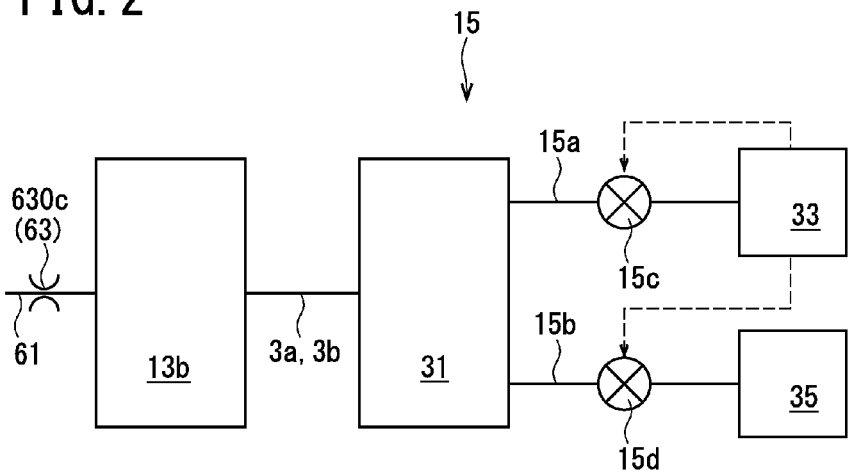
FIG. 2 is a schematic diagram showing a control mechanism, according to the compressor of Embodiment 1.

As shown in FIG. 1, a compressor of Embodiment 1 includes a housing 1, a drive shaft 3, a swash plate 5, a link mechanism 7, a plurality of pistons 9, a plurality of pairs of shoes 11*a* and 11*b*, an actuator 13, and a control mechanism 15 shown in FIG. 2.

As shown in FIG. 1, the housing 1 has a front housing 17 that is located at a front part of the compressor, a rear housing 19 that is located at a rear part of the compressor, a cylinder block 21 that is located between the front housing 17 and the rear housing 19, and a valve formation plate 23.

The front housing 17 has a front wall 17*a* that extends in an up and down direction of the compressor in the front part, and a circumferential wall 17*b* that is integrated with the front wall 17*a* and extends toward the rear part from the front part of the compressor. By the front wall 17*a* and the circumferential wall 17*b*, the front housing 17 forms a substantially cylindrical shape with a bottom. Further, by the front wall 17*a* and the circumferential wall 17*b*, a swash plate chamber 25 is formed in the front housing 17.

In the front wall 17*a*, a boss 17*c* that protrudes forward is formed. In the boss 17*c*, a shaft seal device 27 is provided. Further, in the boss 17*c*, a first shaft hole 17*d* that extends in a longitudinal direction of the compressor is formed. In the first shaft hole 17*d*, a first sliding bearing 29*a* is provided.

In the circumferential wall 17*b*, an inlet port 250 that communicates with the swash plate chamber 25 is formed. Through the inlet port 250, the swash plate chamber 25 is connected to an evaporator not illustrated. Thereby, an intake refrigerant with a low pressure that passes through the evaporator flows into the swash plate chamber 25 through the inlet port 250, and therefore, a pressure in the swash plate chamber 25 is lower than a pressure in a discharge chamber 35 that will be described later.

In the rear housing 19, a part of the control mechanism 15 is provided. Further, in the rear housing 19, a first pressure regulation chamber 31*a*, a suction chamber 33 and a discharge chamber 35 are formed. The first pressure regulation chamber 31*a* is located in a center portion of the rear housing 19. The discharge chamber 35 is located annularly at an outer circumferential side of the rear housing 19. Further, the suction chamber 33 is formed annularly between the first pressure regulation chamber 31*a* and the discharge chamber 35, in the rear housing 19. The discharge chamber 35 is connected to an outlet port not illustrated.

In the cylinder block 21, cylinder bores 21*a* the number of which is the same as the number of the pistons 9 are formed in a circumferential direction at equiangular intervals. Front end sides of the respective cylinder bores 21*a* communicate with the swash plate chamber 25. Further, in the cylinder block 21, a retainer groove 21*b* that regulates a maximum angle of a suction reed valve 41 that will be described later is formed.

Furthermore, in the cylinder block 21, a second shaft hole 21*c* that extends in the longitudinal direction of the compressor while communicating with the swash plate chamber 25 is provided to penetrate the cylinder block 21. In the second shaft hole 21*c*, a second sliding bearing 29*b* is provided. The second shaft hole 21*c* corresponds to a shaft hole in the present invention. Further, in the cylinder block 21, a spring chamber 21*d* is formed. The spring chamber 21*d* is located between the swash plate chamber 25 and the second shaft hole 21*c*. In the spring chamber 21*d*, a return spring 37 is disposed. The return spring 37 urges the swash plate 5 the inclination angle of which is minimum toward a front part of the swash plate chamber 25. Further, in the cylinder block 21, a suction passage 39 that communicates with the swash plate chamber 25 is formed.

The valve formation plate 23 is provided between the rear housing 19 and the cylinder block 21. The valve formation plate 23 consists of a valve plate 40, a suction valve plate 41, a discharge valve plate 43 and a retainer plate 45.

In the valve plate 40, the discharge valve plate 43 and the retainer plate 45, suction ports 40*a* the number of which is the same as the number of the cylinder bores 21*a* are formed.

Further, in the valve plate 40 and the suction valve plate 41, discharge ports 40*b* the number of which is the same as the number of the cylinder bores 21*a* are formed. The respective cylinder bores 21*a* communicate with the suction chamber 33 through the respective suction ports 40*a*, and communicate with the discharge chamber 35 through the respective discharge ports 40*b*. Further, in the valve plate 40, the suction valve plate 41, the discharge valve plate 43 and the retainer plate 45, a first communication hole 40*c* and a second communication hole 40*d* are formed. By the first communication hole 40*c*, the suction chamber 33 and the suction passage 39 communicate with each other. Thereby, the swash plate chamber 25 and the suction chamber 33 communicate with each other.

The suction valve plate 41 is provided on a front surface of the valve plate 40. At the suction valve plate 41, a plurality of suction reed valves 41*a* capable of opening and closing the respective suction ports 40*a* by elastic deformation are formed. Further, the discharge valve plate 43 is provided on a rear surface of the valve plate 40. At the discharge valve plate 43, a plurality of discharge reed valves 43*a* capable of opening and closing the respective discharge ports 40*b* by elastic deformation are formed. The retainer plate 45 is provided on a rear surface of the discharge valve plate 43. The retainer plate 45 restricts a maximum opening degree of the discharge reed valve 43*a*.

The drive shaft 3 is inserted toward a rear side of the housing 1 from a boss 17*c* side. A front end side of the drive shaft 3 is inserted through the shaft seal device 27 in the boss 17*c*, and supported about an axis by the first sliding bearing 29*a* in the first shaft hole 17*d*. Further, a rear end side of the drive shaft 3 is supported about the axis by the second sliding bearing 29*b* in the second shaft hole 21*c*. In this manner, the drive shaft 3 is supported rotatably around a rotational axis O with respect to the housing 1. In the second shaft hole 21*c*, a second pressure regulation chamber 31*b* is defined in a space from a rear end of the drive shaft 3. The second pressure regulation chamber 31*b* communicates with the first pressure regulation chamber 31*a* through the second communication hole 40*d*. By these first and the second pressure regulation chambers 31*a* and 31*b*, a pressure regulation chamber 31 is formed.

Figure 3:
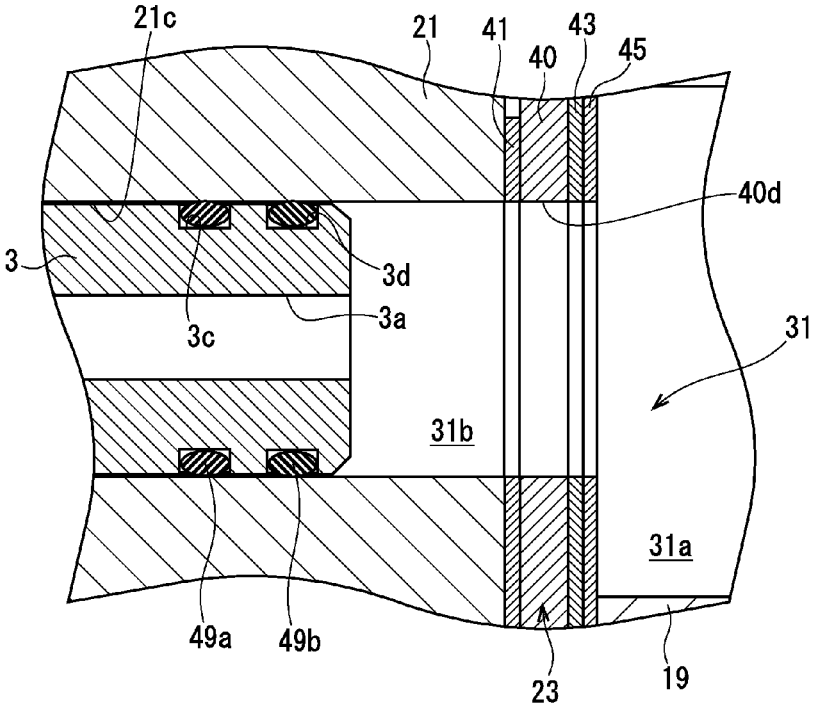
FIG. 3 is an essential part enlarged sectional view showing a rear end portion of a drive shaft, according to the compressor of Embodiment 1.

As shown in FIG. 3, at the rear end of the drive shaft 3, ring grooves 3*c* and 3*d* are formed. In the respective ring grooves 3*c* and 3*d*, rubber O-rings 49*a* and 49*d* are respectively provided. Thereby, the respective O-rings 49*a* and 49*b* are located between the drive shaft 3 and the second shaft hole 21*c* to seal a space between the swash plate chamber 25 and the pressure regulation chamber 31. These respective O-rings 49*a* and 49*b* correspond to sealing members in the present invention.

As shown in FIG. 1, the link mechanism 7, the swash plate 5 and the actuator 13 are fitted to the drive shaft 3. The link mechanism 7 consists of a lug plate 51, a pair of lug arms 53 that are formed at the lug plate 51, and a pair of swash plate arms 5*e* formed at the swash plate 5. Note that in FIG. 1, only one of each of the lug arms 53 and the swash plate arms 5*e* are illustrated. The same also applies to FIG. 6.

As shown in FIG. 1, the lug plate 51 is formed into a substantially annular ring shape. The lug plate 51 is press-fitted onto the drive shaft 3, and is rotatable integrally with the drive shaft 3. The lug plate 51 is located at a front end side in the swash plate chamber 25, and is disposed forward of the swash plate 5. Further, between the lug plate 51 and the front wall 17*a*, a thrust bearing 55 is provided.

Figure 4:
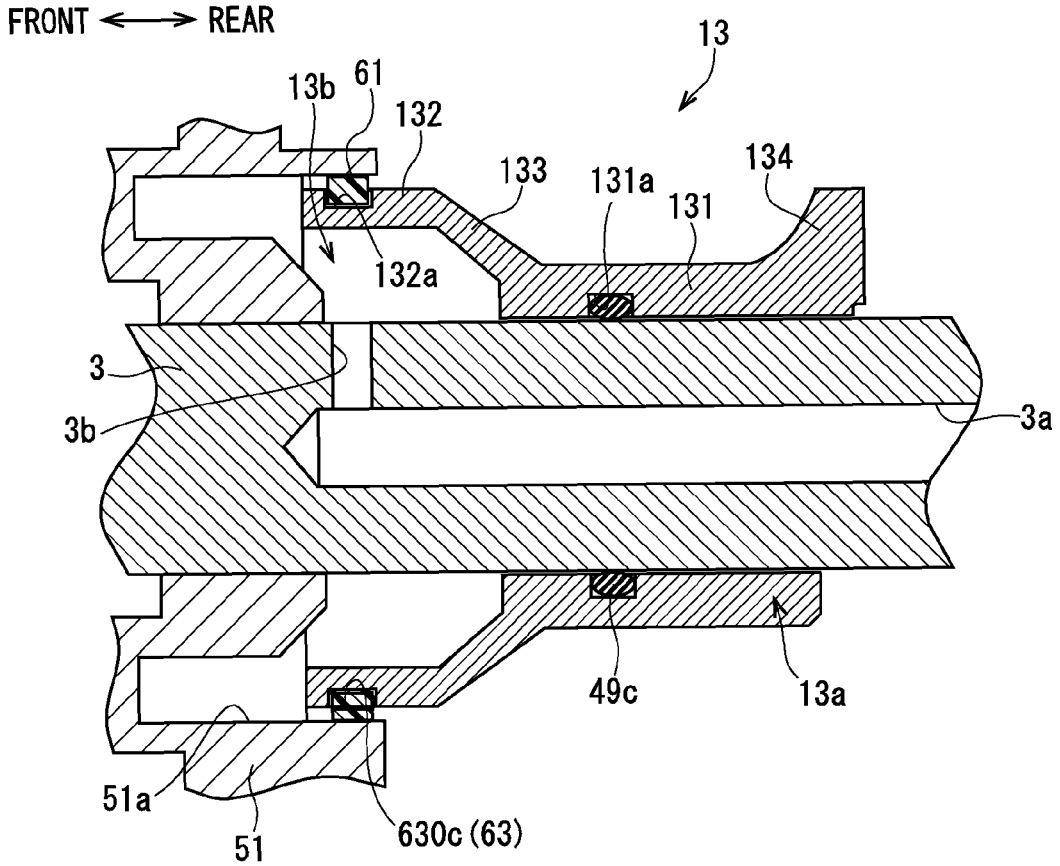
FIG. 4 is an essential part enlarged sectional view showing an actuator, according to the compressor of Embodiment 1.

As shown in FIG. 4, in the lug plate 51, a cylindrical cylinder chamber 51*a* that extends in a longitudinal direction of the lug plate 51 is concavely provided. As shown in FIG. 1, the cylinder chamber 51*a* opens to the swash plate chamber 25 at a rear end surface of the lug plate 51, and extends to a spot to be an inner side of the thrust bearing 55 in the lug plate 51, from the rear end surface of the lug plate 51.

The respective lug arms 53 extend rearward from the lug plate 51. Further, on the lug plate 51, a sliding surface 51*b* is formed at a position between the respective lug arms 53.

The swash plate 5 forms an annular flat plate shape, and has a front surface 5*a* and a rear surface 5*b*. On the front surface 5*a*, a weight portion 5*c* that protrudes forward of the swash plate 5 is formed. The weight portion 5*c* abuts on the lug plate 51 when the inclination angle of the swash plate 5 becomes maximum. Further, in a center of the swash plate 5, an insertion hole 5*d* is formed. The drive shaft 3 is inserted through the insertion hole 5*d*.

The respective swash plate arms 5*e* are formed on the front surface 5*a*. The respective swash plate arms 5*e* extend forward from the front surface 5*a*. Further, in the swash plate 5, a substantially semispherical convex portion 5*g* is protrudingly provided on the front surface 5*a*, and is integrated with the front surface 5*a*. The convex portion 5*g* is located between the respective swash plate arms 5*e*.

In the compressor, the respective swash plate arms 5*e* are inserted between the respective lug arms 53, whereby the lug plate 51 and the swash plate 5 are connected. Thereby, the swash plate 5 is rotatable with the lug plate 51 in the swash plate chamber 25. Like this, the lug plate 51 and the swash plate 5 are connected, whereby in the respective swash plate arms 5*e*, respective tip end sides abut on the sliding surface 51*b*. Subsequently, the respective swash plate arms 5*e* slide on the sliding surface 51*b*, whereby the swash plate 5 can change an inclination angle of its own to a direction orthogonal to the rotational axis O from the maximum inclination angle shown in FIG. 1 to a minimum inclination angle shown in FIG. 6, while substantially keeping a top dead center position T.

The actuator 13 consists of the lug plate 51, a movable body 13*a* and a control pressure chamber 13*b*. In the compressor, the lug plate 51 configures the link mechanism 7 as described above, and also functions as a stationary body in the present invention.

As shown in FIG. 4, the drive shaft 3 is inserted through the movable body 13, and the movable body 13 is movable in the rotational axis O direction while sliding in contact with the drive shaft 3. The movable body 13*a* forms a cylindrical shape coaxial with the drive shaft 3. In more detail, the movable body 13*a* has a first cylinder portion 131, a second cylinder portion 132, and a connection portion 133, as shown in FIG. 4. The first cylinder portion 131 is located at a swash plate 5 side in the movable body 13*a*, and is in sliding contact with the drive shaft 3. The second cylinder portion 132 is located at a front part of the movable body 13*a*. The second cylinder portion 132 is formed to have a larger diameter than the first movable body 131. The connection portion 133 extends while gradually enlarging a diameter toward the front part from a rear part of the movable body 13*a*. In the connection portion 133, a rear end continues to the first cylinder portion 131, and a front end continues to the second cylinder portion 132.

Further, an acting portion 134 is formed integrally with a rear end of the first cylinder portion 131. The acting portion 134 vertically extends toward a top dead center position T side of the swash plate 5 from the rotational axis O side, and is in point contact with the convex portion 5*g*. Thereby, the movable body 13*a* is rotatable integrally with the lug plate 51 and the swash plate 5.

Further, the cylinder chamber 51*a* can accommodate the second cylinder portion 132 and the connection portion 133 by causing the second cylinder portion 132 and the connection portion 133 to advance to an inside (see FIG. 1).

The control pressure chamber 13*b* is formed in a space among the second cylinder portion 132, the connection portion 133, the cylinder chamber 51*a* and the drive shaft 3. Further, a ring groove 131*a* is concavely provided on an inner circumferential surface of the first cylinder portion 131. In the ring groove 131*a*, a rubber O-ring 49*c* is provided. Thereby, the O-ring 49*c* is located between the first cylinder portion 131 and the drive shaft 3. The O-ring 49*c* also corresponds to the sealing member in the present invention.

Further, a ring groove 132*a* is also concavely provided on an outer circumferential surface of the second cylinder portion 132. Here, the second cylinder portion 132 advances into the cylinder chamber 51*a* as described above, and therefore, the ring groove 132*a* is located between the outer circumferential surface of the second cylinder portion 132 and the inner circumferential surface of the cylinder chamber 51*a*, and by extension, between the movable body 13 and the lug plate 51. The ring groove 132*a* corresponds to a concave stripe portion in the present invention. By the ring groove 132*a*, the swash plate chamber 25 and the control pressure chamber 13*b* communicate with each other. Further, in the ring groove 132*a*, an annular member 61 is provided.

Figure 5A:
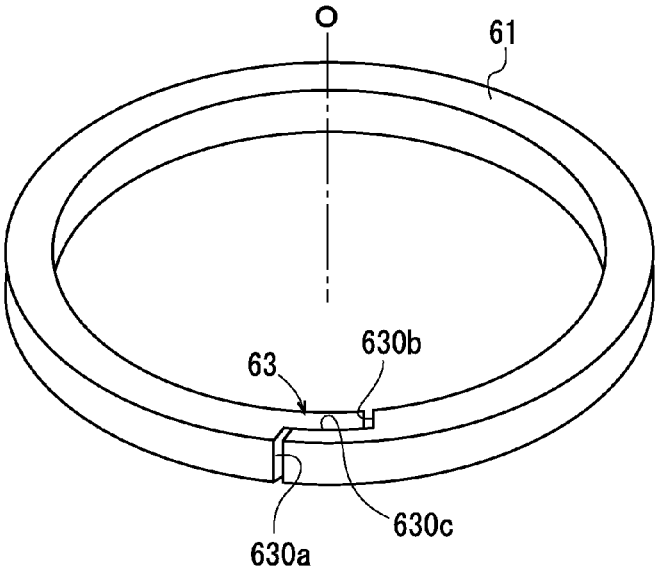
FIGS. 5A to 5C are perspective views and the like showing an annular member, according to the compressor of Embodiment 1.
Figure 5B:
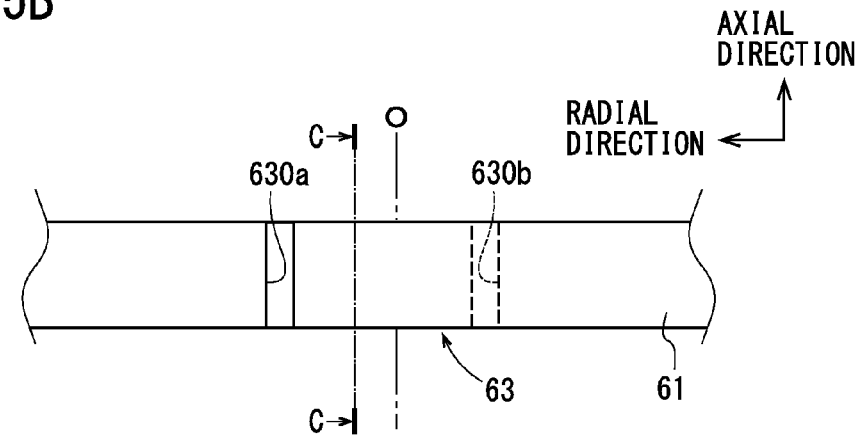
Figure 7A:
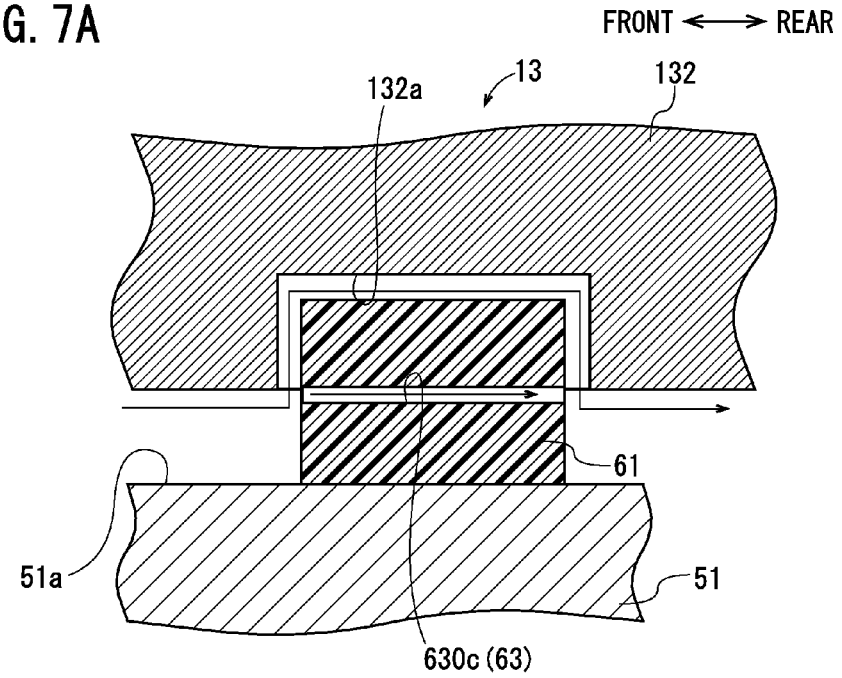
FIGS. 7A and 7B are essential part enlarged sectional views showing positions of the annular member in a ring groove, according to the compressor of Embodiment 1.

The annular member 61 is made of PTFE. As shown in FIG. 5A, the annular member 61 has a joint gap 63. As shown in FIG. 5A and FIG. 5B, the joint gap 63 is formed of a first cutout 630*a*, a second cutout 630*b* and a third cutout 630*c*. The first cutout 630*a* extends in an axial direction of the annular member 61. The second cutout 630*b* extends in the axial direction while deviating in a circumferential direction of the annular member 61 with respect to the first cutout 630*a*. The third cutout 630*c* extends in the circumferential direction in a center in a thickness direction of the annular member 61, and continues to the first cutout 630*a* and the second cutout 630*b*. By these first to third cutouts 630*a* to 630*c*, the joint gap 63 forms a crank shape. As shown in FIG. 7A, the annular member 61 is provided in the ring groove 132*a*, whereby the third cutout 630*c* always allows the control pressure chamber 13*b* and the swash plate chamber 25 to communicate with each other. Therefore, as shown by the solid arrow in FIG. 7A, the refrigerant can flow through the third cutout 630*c*.

Figure 5C:
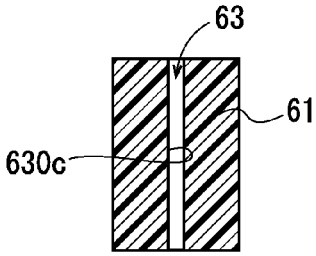

Here, as shown in FIG. 5C, in the joint gap 63, the third cutout 630*c* is formed so that a channel area for the refrigerant becomes smaller as compared with the first and the second cutouts 630*a* and 630*b*. Thereby, the third cutout 630*c* becomes an aperture in the annular member 61. A space between the outer circumferential surface of the second cylinder portion 132 and the inner circumferential surface of the cylinder chamber 51*a*, the ring groove 132*a* and the third cutout 630*c* function as bleed passages in the present invention. Note that the annular member 61 may be formed from a metal or the like.

As shown in FIG. 1, in the drive shaft 3, an axial path 3*a* that extends in the rotational axis O direction toward the front end from the rear end of the drive shaft 3, and a radial path 3*b* that extends in a radial direction from a front end of the axial path 3*a* and opens to the outer circumferential surface of the drive shaft 3 are formed. A rear end of the axial path 3*a* opens to the pressure regulation chamber 31. Meanwhile, the radial path 3*b* opens to the control pressure chamber 13*b*. By the axial path 3*a* and the radial path 3*b*, the pressure regulation chamber 31 and the control pressure chamber 13*b* communicate with each other.

The drive shaft 3 is connected to a pulley or an electromagnetic clutch not illustrated, by a screw portion 3*e* that is formed at a tip end.

The respective pistons 9 are respectively accommodated in the respective cylinder bores 21*a*, and are capable of reciprocating in the respective cylinder bores 21*a*. By the respective pistons 9 and the valve formation plate 23, compression chambers 57 are defined in the respective cylinder bores 21*a*.

Further, in the respective pistons 9, engaging portions 9*a* are concavely provided respectively. In the engaging portion 9*a*, the semispherical shoes 11*a* and 11*b* are respectively provided. The respective shoes 11*a* and 11*b* convert rotation of the swash plate 5 into reciprocal movement of the respective pistons 9. The respective shoes 11*a* and 11*b* correspond to a conversion mechanism in the present invention. In this manner, the respective pistons 9 can reciprocate in the cylinder bores 21*a* respectively at a stroke corresponding to the inclination angle of the swash plate 5.

As shown in FIG. 2, the control mechanism 15 is configured by a low-pressure passage 15*a*, a high-pressure passage 15*b*, a low-pressure control valve 15*c*, a high-pressure control valve 15*d*, the axial path 3*a*, the radial path 3*b* and the above described ring groove 132*a*.

The low-pressure passage 15*a* is connected to the pressure regulation chamber 31 and the suction chamber 33. By the low-pressure passage 15*a*, the axial path 3*a* and the radial path 3*b*, the control pressure chamber 13*b*, the pressure regulation chamber 31 and the suction chamber 33 communicate with one another. The high-pressure passage 15*b* is connected to the pressure regulation chamber 31 and the discharge chamber 35. By the high-pressure passage 15*b*, the axial path 3*a* and the radial path 3*b*, the control pressure chamber 13*b*, the pressure regulation chamber 31 and the discharge chamber 35 communicate with one another. Like this, the high-pressure passage 15, the axial path 3*a* and the radial path 3*b* configure a supply passage in the present invention.

The low-pressure control valve 15*c* is provided in the low-pressure passage 15*a*. The low-pressure control valve 15*c* can regulate an opening degree of the low-pressure passage 15*a* based on a pressure in the suction chamber 33. Further, the high-pressure control valve 15*d* is provided in the high-pressure passage 15*b*. The high-pressure control valve 15*d* can regulate an opening degree of the high-pressure passage 15*b* based on the pressure in the suction chamber 33.

In the compressor, piping connecting to the evaporator is connected to the inlet port 250 shown in FIG. 1, and piping connecting to a condenser is connected to the outlet port. The condenser is connected to the evaporator via piping and an expansion valve. By the compressor, the evaporator, the expansion valve, the condenser and the like, a refrigerant circuit of an air-conditioning apparatus for a vehicle is configured. Note that illustration of the evaporator, the expansion valve, the condenser and the respective pipings are omitted.

In the compressor which is configured as above, the drive shaft 3 rotates, whereby the swash plate 5 rotates, and the respective pistons 9 reciprocate in the respective cylinder bores 21*a*. Therefore, the compression chamber 57 changes a capacity in response to a piston stroke. Therefore, the refrigerant which is taken into the swash plate chamber 25 by the inlet port 250 from the evaporator passes through the suction chamber 33 from the suction passage 39 and is compressed in the compression chamber 57. Subsequently, the refrigerant which is compressed in the compression chamber 57 is discharged into the discharge chamber 35 and is discharged into the condenser from the outlet port.

In the compressor, the inclination angle of the swash plate 5 is changed by the actuator 13, and the stroke of the piston 9 is increased or decreased, whereby change in the discharge capacity can be performed.

More specifically, in the compressor, in the control mechanism 15, the high-pressure control valve 15*d* shown in FIG. 2 regulates the opening degree of the high-pressure passage 15*b*, whereby the pressure in the pressure regulation chamber 31, and by extension, in the control pressure chamber 13*b* is increased by the refrigerant in the discharge chamber 35. Further, regulation of the opening degree of the low-pressure passage 15*a* by the low-pressure control valve 15*c* is performed, whereby the pressure in the control pressure chamber 13*b* is reduced. Furthermore, in the compressor, the refrigerant in the control pressure chamber 13*b* is discharged to the swash plate chamber 25 through the space between the outer circumferential surface of the second cylinder portion 132 and the inner circumferential surface of the cylinder chamber 51*a*, the ring groove 132*a* and the third cutout 630*c* of the annular member 61. In this manner, in the compressor, the pressure in the control pressure chamber 13*b* is regulated.

Here, if the high-pressure control valve 15*d* decreases the opening degree of the high-pressure passage 15*b*, and the low-pressure control valve 15*c* increases the opening degree of the low-pressure passage 15*a*, the pressure in the control pressure chamber 13*b* reduces. Therefore, a pressure difference between the control pressure chamber 13*b* and the swash plate chamber 25 becomes small. In a state in which the pressure difference between the control pressure chamber 13*b* and the swash plate chamber 25 is small like this, the refrigerant in the control pressure chamber 13 flows through both a gap between the ring groove 132*a* and the annular member 61, and the third cutout 630*c*, and flows to the swash plate chamber 25, as shown by the solid arrows in FIG. 7A.

Thereby, in the compressor, the pressure in the control pressure chamber 13*b* is quickly reduced. Therefore, by a piston compression force that acts on the swash plate 5, in the actuator 13, the movable body 13*a* slides in the cylinder chamber 51*a* toward the lug plate 51 side from the swash plate 5 side in the rotational axis O direction, and the capacity of the control pressure chamber 13*b* decreases, as shown in FIG. 1. Subsequently, the second cylinder portion 132 and the connection portion 133 of the movable body 13*a* advance into the cylinder chamber 51*a*.

Further, at the same time, in the compressor, the respective swash plate arms 5*e* slide on the sliding surface 51*b* so as to be away from the rotational axis O. Therefore, in the swash plate 5, a bottom dead center side pivots in a clockwise direction while substantially keeping the top dead center position T. In this manner, in the compressor, the inclination angle of the swash plate 5 to the rotational axis O of the drive shaft 3 increases. Thereby, in the compressor, the stroke of the piston 9 increases, and the discharge capacity per one rotation of the drive shaft 3 becomes large. Note that the inclination angle of the swash plate 5 shown in FIG. 1 is a maximum inclination angle in the compressor.

Figure 6:
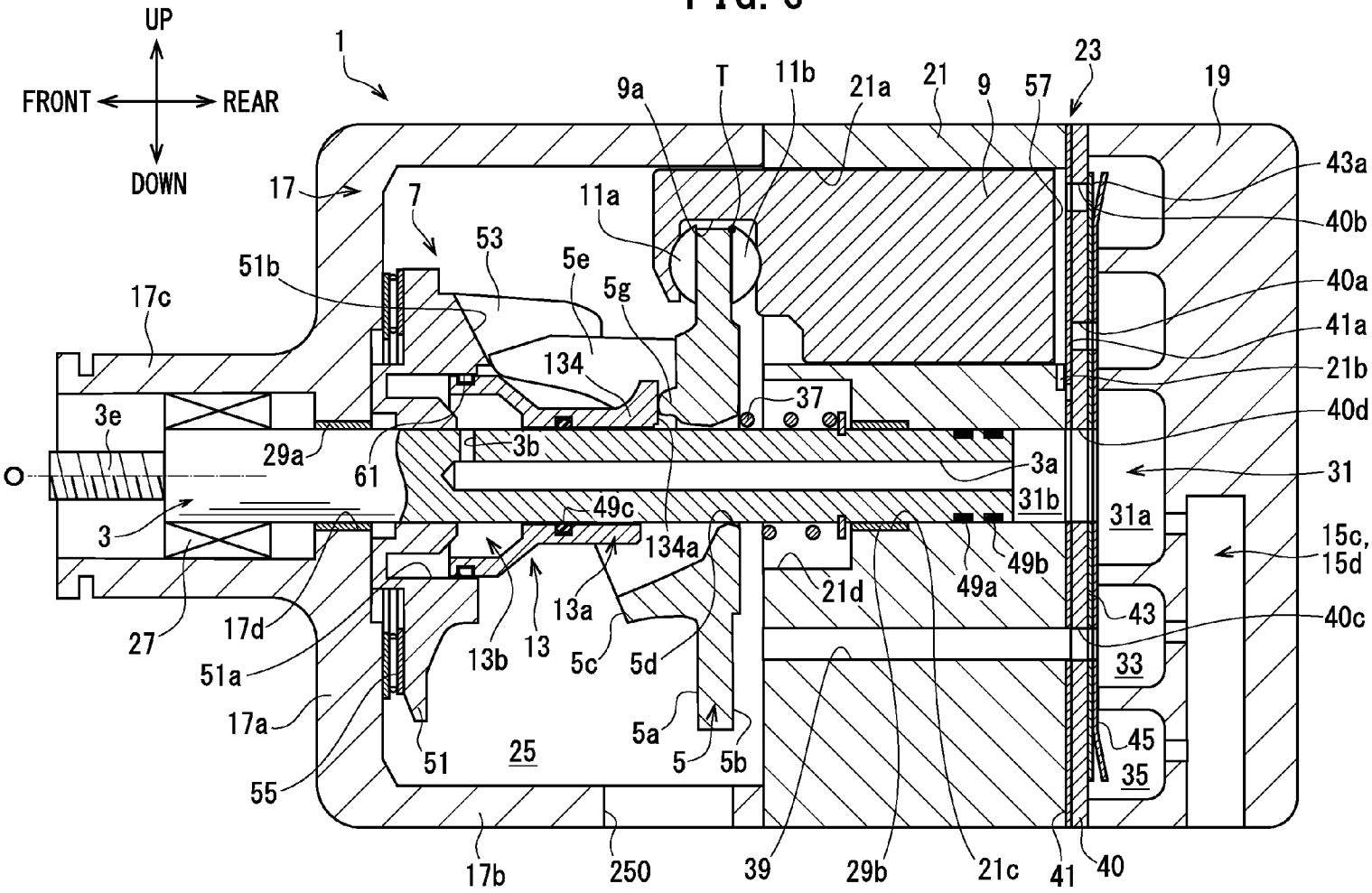
FIG. 6 is a sectional view at a time of a minimum capacity in the compressor of Embodiment 1.
Figure 7B:
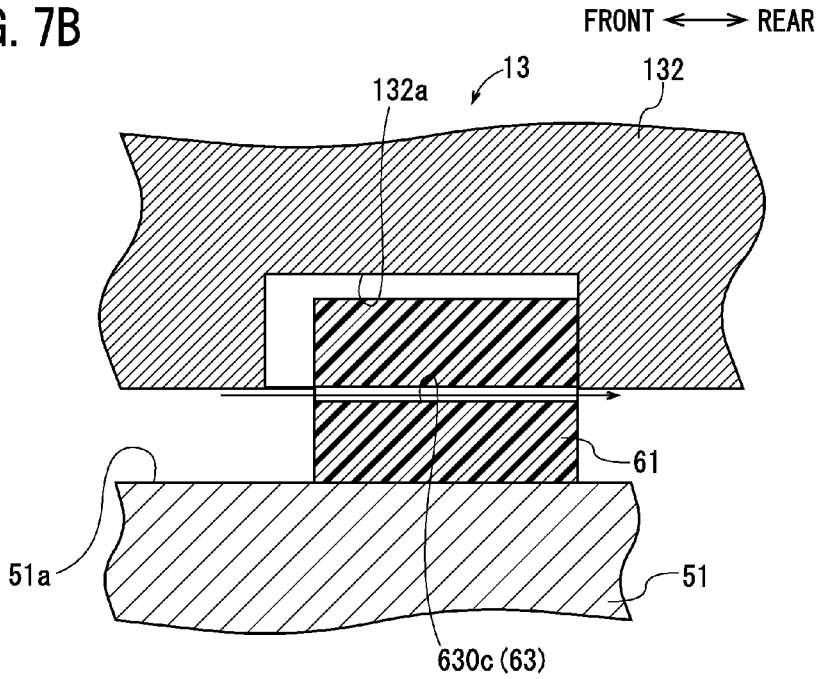

Meanwhile, if the high-pressure control valve 15*d* shown in FIG. 2 increases the opening degree of the high-pressure passage 15*b*, and the low-pressure control valve 15*c* decreases the opening degree of the low-pressure passage 15*a*, the pressure in the control pressure chamber 13*b* becomes high. Therefore, the pressure difference between the control pressure chamber 13*b* and the swash plate chamber 25 becomes large. In a state in which the pressure difference between the control pressure chamber 13*b* and the swash plate chamber 25 is large like this, the annular member 61 moves rearward in the ring groove 132*a* by the pressure in the control pressure chamber 13. Thereby, as shown in FIG. 7B, the annular member 61 abuts on a rear wall surface of the ring groove 132*a*, and in the abutting spot, the gap between the annular member 61 and the ring groove 132*a* is closed. Therefore, as shown by the solid arrow in FIG. 7B, the refrigerant in the control pressure chamber 13 flows through only the third cutout 630*c*, and flows to the swash plate chamber 25. Namely, as compared with the state in which the pressure difference between the control pressure chamber 13*b* and the swash plate chamber 25 is small as shown in FIG. 7A, a flow of the refrigerant which flows to the swash plate chamber 25 from the inside of the control pressure chamber 13 is decreased. Therefore, the pressure in the control pressure chamber 13*b* favorably increases. Thereby, as shown in FIG. 6, the movable body 13*a* slides in the cylinder chamber 51*a* in the rotational axis O direction toward the swash plate 5 side while moving away from the lug plate 51, and therefore, in the actuator 13, a capacity of the control pressure chamber 13*b* increases.

Thereby, in the compressor, the acting portion 134 presses the convex portion 5*g* toward the rear part of the swash plate chamber 25. Therefore, the respective swash plate arms 5*e* slide on the sliding surface 51*b* to be close to the rotational axis O. Thereby, in the swash plate 5, the bottom dead center side pivots in a counterclockwise direction while the top dead center position T is substantially kept. In this manner, in the compressor, the inclination angle of the swash plate 5 with respect to the rotational axis O of the drive shaft 3 is decreased. Thereby, in the compressor, the stroke of the piston 9 decreases, and the discharge capacity per one rotation of the drive shaft 3 becomes small. Note that the inclination angle of the swash plate 5 shown in FIG. 6 is a minimum inclination angle in the compressor.

As above, in the compressor, based on the pressure difference between the control pressure chamber 13*b* and the swash plate chamber 25, the annular member 61 regulates the flow of the refrigerant which flows through the ring groove 132*a* and regulates the pressure in the control pressure chamber 13*b*. In this manner, in the compressor, the discharge capacity per one rotation of the drive shaft 3 can be changed. In this manner, in the compressor, the annular member 61 functions as a pressure regulation valve that regulates the pressure in the control pressure chamber 13*b*. Here, the annular member 61 has a simple configuration having the joint gap 63 including the third cutout 630*c* to be the aperture, and therefore, in the compressor, the annular member 61 can be caused to function as the pressure regulation valve while the annular member 61 is disposed around the movable body 13*a* which configures a rotary body with the drive shaft 3 and the like.

In this manner, in the compressor, the pressure of the control pressure chamber 13*b* is regulated while the refrigerant is discharged to the swash plate chamber 25 from the control pressure chamber 13*b* through the ring groove 132*a*, and therefore, the control pressure chamber 13*b* does not have to be completely sealed from the swash plate chamber 25. More specifically, in the compressor, it is sufficient if the space between the pressure regulation chamber 31 and the swash plate chamber 25 is sealed by the O-rings 49*a* and 49*b*, and the space between the first cylinder portion 131 and the drive shaft 3 is sealed by the O-ring 49*c*. In this manner, in the compressor, work and means for sealing the control pressure chamber 13*b* are simplified.

Consequently, according to the compressor of Embodiment 1, in the compressor that changes the discharge capacity by using the actuator 13, reduction in manufacture cost can be realized.

In particular, the joint gap 63 of the annular member 61 is configured by the first to the third cutouts 630*a* to 630*c*, and the third cutout 630*c* is made the aperture. Here, when the annular member 61 is assembled to the second cylinder portion 132 of the movable body 13*a*, in the first and the second cutouts 630*a* and 630*b* which extend in the axial direction, widths, that is, the channel areas at the time of the refrigerant flowing easily change due to a tolerance of the diameter of the second cylinder portion 132, and a tolerance at the time of assembly and the like. In contrast with this, in the third cutout 630*c* which extends in the circumferential direction, the channel area is difficult to change even when the annular member 61 is assembled to the second cylinder portion 132. Therefore, by making the third cutout 630*c* the aperture, the flow of the refrigerant which flows to the swash plate chamber 25 from the control pressure chamber 13*b* through the ring groove 132*a* can be favorably regulated in the compressor.

Further, the annular member 61 is provided in only the ring groove 132*a* of the second cylinder portion 132, and the O-rings 49*a* to 49*c* are respectively provided between the drive shaft 3 and the second shaft hole 21*c*, and between the first cylinder portion 131 and the drive shaft 3. Therefore, in the compressor, in a position close to the control pressure chamber 13*b*, the flow of the refrigerant which is discharged from the inside of the control pressure chamber 13*b* can be regulated by the single annular member 61, and therefore regulation of the pressure in the control pressure chamber 13*b* is facilitated. Further, since the annular member 61 is made of PTFE, slidability of the movable body 13*a* is ensured.

Furthermore, in the compressor, the control mechanism. 15 has the low-pressure passage 15*a* and the low-pressure control valve 15*c*, and therefore, the pressure in the control pressure chamber 13*b* can be reduced by not only regulation of the flow of the refrigerant by the annular member 61, but also regulation of the opening degree of the low-pressure passage 15*a*. Therefore, in the compressor, a reduction speed of the pressure in the control pressure chamber 13*b* can be regulated, and change of the discharge capacity can be quickly performed.

Embodiment 2

Figure 8A:
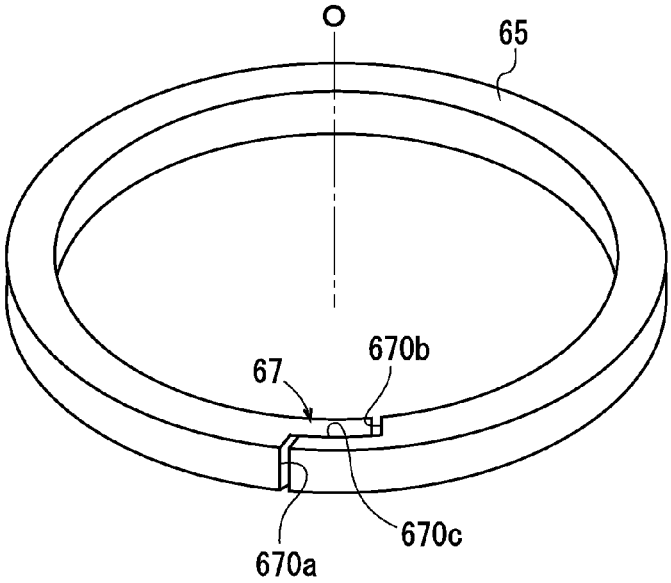
FIG. 8A to 8C are perspective views and the like showing an annular member, according to a compressor of Embodiment 2.

A compressor in Embodiment 2 adopts an annular member 65 shown in FIG. 8A, in place of the annular member 61 in the compressor in Embodiment 1. The annular member 65 is also made of PTFE. Further, the annular member 65 is also provided in the ring groove 132*a* of the second cylinder portion 132, and is located between the outer circumferential surface of the second cylinder portion 132 and the inner circumferential surface of the cylinder chamber 51*a*.

Figure 8B:
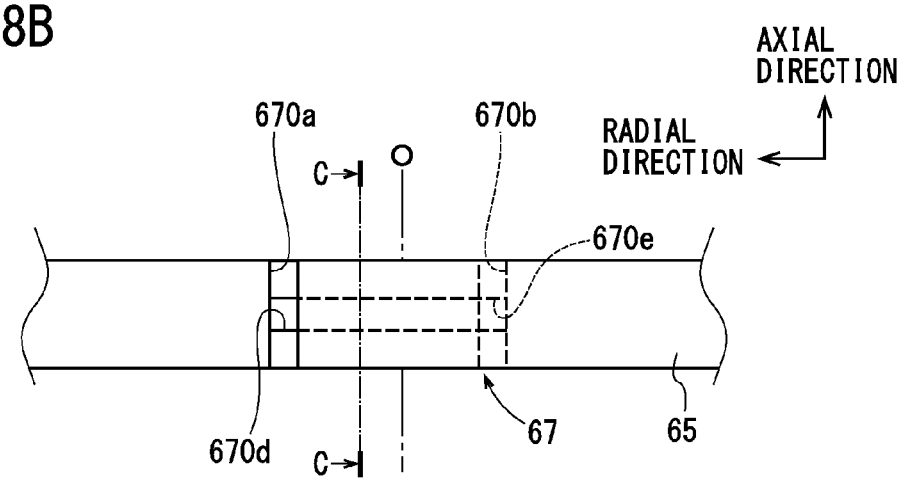
Figure 8C:
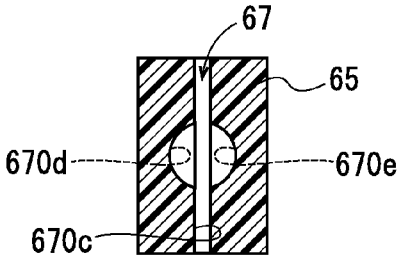

The annular member 65 has a joint gap 67 forming a crank shape. As shown in FIG. 8A and FIG. 8B, the joint gap 67 is formed by first to third cutouts 670*a* to 670*c* and a pair of communication grooves 670*d* and 670*e*. The first cutout 670*a* extends in an axial direction of the annular member 65. The second cutout 670*b* extends in the axial direction of the annular member 65 while deviating in a circumferential direction with respect to the first cutout 670*a*. The third cutout 670*c* extends in the circumferential direction in a center in a thickness direction of the annular member 65, and continues to the first cutout 670*a* and the second cutout 670*b*. In the respective communication grooves 670*d* and 670*e*, sections parallel with the axial direction form substantially semicircular shapes as shown in FIG. 8C. The respective communication grooves 670*d* and 670*e* extend along the third cutout 670*c* while facing each other with the third cutout 670*c* therebetween, and respectively continue to the first cutout 670*a* and the second cutout 670*b*.

The annular member 65 is also provided in the ring groove 132*a*, whereby the third cutout 670*c* always allows the control pressure chamber 13*b* and the swash plate chamber 25 to communicate with each other. Here, in the joint gap 67, the third cutout 670*c* is also formed so that a channel area for a refrigerant becomes smaller as compared with the first and the second cutouts 670*a* and 670*b*. Thereby, the third cutout 670*c* becomes an aperture in the annular member 65. A space between the outer circumferential surface of the second cylinder portion 132 and the inner circumferential surface of the cylinder chamber 51*a*, the ring groove 132*a* and the third cutout 670*c* function as the bleed passage in the present invention. Here, in the annular member 65, the channel area of the third cutout 670*c* is regulated by the communication grooves 670*d* and 670*e*. Note that shapes and numbers of the communication grooves 670*d* and 670*e* can be properly designed. Note that the annular member 65 may be formed of a metal or the like. The other components in the compressor are similar to those in the compressor of Embodiment 1, and detailed explanation concerning the same components will be omitted by assigning the same reference sings to the same components.

Similarly to the compressor in Embodiment 1, in this compressor, the annular member 65 moves in the ring groove 132*a* based on the pressure difference between the control pressure chamber 13*b* and the swash plate chamber 25. Thereby, in this compressor, the annular member 65 regulates a flow of the refrigerant that flows through the ring groove 132*a*, and can regulate the pressure in the control pressure chamber 13*b*. On this occasion, in the annular member 65, the flow of the refrigerant which flows to the swash plate chamber 25 from the control pressure chamber 13*b* can also be regulated by the communication grooves 670*d* and 670*e*. The other operation in this compressor is similar to that of the compressor of Embodiment 1.

In the above, the present invention is described based on Embodiments 1 and 2, but the present invention is not limited to the above described Embodiments 1 and 2, and it goes without saying that the present invention can be properly changed within the range without departing from the gist of the present invention.

For example, the compressor may be configured by providing the annular member 61 or 65 for the ring groove 131*a*, instead of the ring groove 132*a*. In this case, the ring groove 131*a* corresponds to the concave stripe portion in the present invention.

Further, the compressor may be configured by further providing the annular members 61 and 65 in the ring groove 131*a* while providing the annular members 61 and 65 in the ring groove 132*a*. In this case, a leakage amount of the refrigerant is regulated by the plurality of annular members 61 and 65, whereby, the pressure in the control pressure chamber 13*b* can be regulated.

Furthermore, by also providing a cylinder bore, a compression chamber, a suction chamber, a discharge chamber and the like at the front housing 17 side, the compressor may be configured as a variable displacement double head swash plate type compressor.

The annular member is preferably made of a resin such as PEEK (polyether ether ketone), PPS (polyphenylene sulfide), and PTFE (polytetrafluoroethylene).

Further, one annular member or a plurality of annular members may be provided in the bleed passage.

The invention claimed is:

1. A variable displacement swash plate type compressor comprising a housing in which a suction chamber, a discharge chamber, a swash plate chamber and a cylinder bore are formed, a drive shaft that is rotatably supported by the housing, a swash plate rotatable in the swash plate chamber by rotation of the drive shaft, a link mechanism that is provided between the drive shaft and the swash plate, and allows change of an inclination angle of the swash plate to a direction orthogonal to a rotational axis of the drive shaft, a piston that is accommodated in the cylinder bore to be capable of reciprocating, a conversion mechanism that causes the piston to reciprocate in the cylinder bore at a stroke corresponding to the inclination angle by rotation of the swash plate, an actuator capable of changing the inclination angle, and a control mechanism that controls the actuator, wherein the swash plate chamber communicates with the suction chamber, the actuator has a stationary body fixed to the drive shaft in the swash plate chamber, a movable body movable in a direction of the rotational axis in the swash plate chamber, and a control pressure chamber defined by the stationary body and the movable body, the control mechanism has a supply passage that communicates with the discharge chamber and the control pressure chamber, and introduces a refrigerant in the discharge chamber to the control pressure chamber, and a bleed passage that communicates with the swash plate chamber and the control pressure chamber, and discharges the refrigerant in the control pressure chamber to the swash plate chamber, the bleed passage is provided at least one of a space between the movable body and the drive shaft and a space between the movable body and the stationary body, the bleed passage is provided with an annular member having an aperture that always allows the control pressure chamber and the swash plate chamber to communicate with each other, and the annular member regulates a flow of the refrigerant that flows through the bleed passage by moving in the bleed passage based on a pressure difference between the control pressure chamber and the swash plate chamber.

2. The variable displacement swash plate type compressor according to claim 1, wherein the bleed passage has a concave stripe portion formed between the movable body and the stationary body or between the movable body and the drive shaft, and the annular member is disposed in the concave stripe portion.

3. The variable displacement swash plate type compressor according to claim 1, wherein the annular member has a first cutout that extends in an axial direction parallel with the rotational axis, a second cutout that extends in the axial direction in an extending direction of the first cutout while deviating in a circumferential direction orthogonal to the axial direction with respect to the first cutout, and a third cutout that extends in the circumferential direction and connects the first cutout and the second cutout, and the third cutout is the aperture.

4. The variable displacement swash plate type compressor according to claim 1, wherein the movable body is slidably provided on the drive shaft, the movable body has, around the drive shaft, a first cylinder portion disposed at the swash plate side, a second cylinder portion that has a diameter enlarged more than the first cylinder portion, and a connection portion that connects the first cylinder portion and the second cylinder portion, the stationary body has a cylinder chamber that accommodates the second cylinder portion while configuring the control pressure chamber, and the annular member is provided between an outer circumferential surface of the second cylinder portion and an inner circumferential surface of the cylinder chamber.

5. The variable displacement swash plate type compressor according to claim 4, wherein in the housing, a pressure regulation chamber that communicates with the control pressure chamber, and a shaft hole that allows the swash plate chamber and the pressure regulation chamber to communicate with each other, and allows the drive shaft to be rotatably inserted therethrough are formed, and sealing members are provided between the drive shaft and the shaft hole, and between the first cylinder portion and the drive shaft.

* * * * *